US006170960B1

(12) United States Patent
Maglica

(10) Patent No.: US 6,170,960 B1
(45) **Date of Patent: *Jan. 9, 2001**

(54) MINIATURE FLASHLIGHT

(75) Inventor: Anthony Maglica, Ontario, CA (US)

(73) Assignee: MAG Instrument Inc., Ontario, CA (US)

( * ) Notice: Under 35 U.S.C. 154(b), the term of this patent shall be extended for 0 days.

This patent is subject to a terminal disclaimer.

(21) Appl. No.: 09/305,499

(22) Filed: May 5, 1999

Related U.S. Application Data

(63) Continuation of application No. 09/064,468, filed on Apr. 22, 1998, which is a continuation of application No. 08/514,715, filed on Aug. 14, 1995, now Pat. No. 5,806,964, which is a continuation of application No. 08/136,349, filed on Oct. 14, 1993, now abandoned, which is a continuation of application No. 07/938,626, filed on Sep. 1, 1992, now Pat. No. 5,293,307, which is a continuation of application No. 07/809,846, filed on Dec. 18, 1991, now Pat. No. 5,143,441, which is a continuation of application No. 07/553,977, filed on Jul. 16, 1990, now abandoned, which is a continuation of application No. 07/356,361, filed on May 23, 1989, now Pat. No. 4,942,505, which is a continuation of application No. 07/222,378, filed on Jul. 18, 1988, now Pat. No. 4,899,265, which is a continuation of application No. 07/034,918, filed on Apr. 6, 1987, now abandoned, which is a continuation of application No. 06/828,729, filed on Feb. 11, 1986, now Pat. No. 4,658,336, which is a continuation of application No. 06/648,032, filed on Sep. 6, 1984, now Pat. No. 4,577,263.

(51) Int. Cl.[7] ..... F21L 4/00
(52) U.S. Cl. ..... 362/205; 362/187
(58) Field of Search ..... 362/204, 205, 362/187, 202

(56) References Cited

U.S. PATENT DOCUMENTS

| | | | |
|---|---|---|---|
| 1,584,539 | 5/1926 | Hopkins | 362/188 |
| 1,603,272 | 10/1926 | Eaton . | |
| 1,608,195 | 11/1926 | Barany . | |
| 1,638,716 | 8/1927 | Surles . | |

(List continued on next page.)

FOREIGN PATENT DOCUMENTS

| | | |
|---|---|---|
| 114558 | 1/1942 | (AU) . |
| 138873 | 4/1948 | (AU) . |
| 90 30 6589 | 8/1990 | (EP) . |
| 2372382 | 6/1976 | (FR) . |
| 2372382 | 11/1976 | (FR) . |
| 292836 | 6/1928 | (GB) . |
| 411218 | 6/1934 | (GB) . |
| 549104 | 11/1942 | (GB) . |
| 752619 | 7/1956 | (GB) . |
| 812980 | 5/1959 | (GB) . |
| 2107038 | 4/1983 | (GB) . |
| 5-14620 | 11/1930 | (JP) . |
| 14-19704 | 12/1939 | (JP) . |

OTHER PUBLICATIONS

1939 Eveready Flashlight Model No. 9351.
1939 Eveready Flashlight Model No. 2672.
Eveready Flashlight Model No. 3773.
Mag Instrument, Inc., Brochure Illustrating Flashlight of Maglica Patent No. 4,286,311.

*Primary Examiner*—Stephen Husar
(74) *Attorney, Agent, or Firm*—Lyon & Lyon LLP

(57) ABSTRACT

A miniature flashlight comprising a barrel, tailcap, head, bulb holder, bulb and an electrical circuit. The bulb holder is positioned at one end of the barrel such that the bulb extends into the head. The head includes a parabolic reflector surrounding the bulb such that the rotation of the head relative to the barrel changes the focus of the flashlight beam. A rotary switch associates the bulb holder with the barrel to control opening and closing of the electrical circuit. Rotation of the head away from the barrel closes the electrical circuit. The head is not a part of the electrical circuit and its removal exposes the bulb for substantially spherical illumination. The head assembly is removable from the barrel for use as a base into which the tailcap is inserted to stand the miniature flashlight in its "on" condition, as a lamp.

16 Claims, 2 Drawing Sheets

U.S. PATENT DOCUMENTS

| | | | |
|---|---|---|---|
| 1,644,126 | 10/1927 | Harris . | |
| 1,674,650 | 6/1928 | Leser . | |
| 1,680,169 | 3/1928 | Osean | 362/188 |
| 1,758,835 | 5/1930 | Hime . | |
| 1,851,503 | 3/1932 | Flamm . | |
| 2,016,819 | 10/1935 | Meginniss | 362/188 |
| 2,097,222 | 10/1937 | Tompkins | 362/187 |
| 2,173,650 | 9/1939 | Fullmer | 240/10.66 |
| 2,176,301 | 10/1939 | Haas | 123/187 |
| 2,212,103 | 8/1940 | Rothenberg et al. | 240/10.69 |
| 2,272,907 | 2/1942 | Deibel | 240/10.61 |
| 2,339,356 | 1/1944 | Sachs | 362/187 |
| 2,490,830 | 2/1949 | Norton | 362/184 |
| 2,530,913 | 11/1950 | Shackel | 123/187 |
| 2,599,295 | 6/1952 | Thomas | 362/205 |
| 2,915,621 | 12/1959 | Garland | 362/205 |
| 2,931,005 | 3/1960 | Saurwein | 362/205 |
| 2,945,944 | 7/1960 | Gillespie | 362/188 |
| 3,014,125 | 12/1961 | Draudt | 240/10.68 |
| 3,076,891 | 2/1963 | Moore | 362/202 |
| 3,652,846 | 3/1972 | Starck, II | 240/10.63 |
| 4,114,187 | 9/1978 | Uke | 362/158 |
| 4,151,583 | 4/1979 | Miller | 362/207 |
| 4,156,271 | 5/1979 | Vercellotti | 362/202 |
| 4,171,534 | 10/1979 | Strowe | 362/183 |
| 4,203,150 | 5/1980 | Shamlian | 362/183 |
| 4,234,913 | 11/1980 | Ramme | 362/158 |
| 4,261,026 | 4/1981 | Bolha | 362/101 |
| 4,286,311 | 8/1981 | Maglica | 362/205 |
| 4,329,740 | 5/1982 | Colvin | 362/184 |
| 4,388,673 | 6/1983 | Maglica | 362/205 |
| 4,398,232 | 8/1983 | Elmore | 362/187 |
| 4,398,238 | 8/1983 | Nelson | 362/184 |
| 4,429,351 | 1/1984 | Petzl | 362/187 |
| 4,472,766 | 9/1984 | Hung | 362/205 |
| 4,495,551 | 1/1985 | Foltz | 362/205 |
| 4,527,223 | 7/1985 | Maglica | 362/207 |
| 4,531,178 | 7/1985 | Uke | 362/202 |
| 4,570,208 | 2/1986 | Sassmannshausen | 362/188 |
| 4,577,263 | 3/1986 | Maglica | 362/187 |
| 4,656,565 | 4/1987 | Maglica | 362/187 |
| 4,658,336 | 4/1987 | Maglica | 362/187 |
| 4,695,551 | 9/1987 | Samhaber et al. | 435/292 |
| 4,725,932 | 2/1988 | Gammache | 362/202 |
| 4,733,337 | 3/1988 | Bieberstein | 362/206 |
| 4,777,582 | 10/1985 | Sharrah | 362/202 |
| 4,841,417 | 6/1989 | Maglica et al. | 362/206 |
| 4,843,526 | 6/1989 | Price, III | 362/187 |
| 4,864,474 | 9/1989 | Maglica | 362/203 |
| 4,888,670 | 12/1989 | Sharrah | 362/205 |
| 4,899,265 | 2/1990 | Maglica | 362/203 |
| 4,942,505 | 7/1990 | Maglica | 362/203 |
| 4,951,183 | 8/1990 | Wang | 362/187 |
| 4,967,325 | 10/1990 | Shiau | 362/188 |
| 5,113,326 | 5/1992 | Maglica | 362/158 |
| 5,126,972 | 6/1992 | Reeves et al. | 362/187 |
| 5,138,537 | 8/1992 | Wang | 362/187 |
| 5,158,358 | 10/1992 | Maglica et al. | 362/206 |

MINIATURE FLASHLIGHT

This application is a continuation of application Ser. No. 09/064,468, filed Apr. 22, 1998, now allowed; which is a continuation of application Ser. No. 08/514,715, filed Aug. 14, 1995, now U.S. Pat. No. 5,806,964; which is a continuation of application Ser. No. 08/136,349, filed Oct. 14, 1993, now abandoned; which is a continuation of application Ser. No. 07/938,626, filed Sep. 1, 1992, now U.S. Pat. No. 5,293,307; which is a continuation of application Ser. No. 07/809,846, filed Dec. 18, 1991, now U.S. Pat. No. 5,143,441; which is a continuation of application Ser. No. 07/553,977, filed Jul. 16, 1990, now abandoned; which is a continuation of application Ser. No. 07/356,361, filed May 23, 1989, now U.S. Pat. No. 4,942,505; which is a continuation of application Ser. No. 07/222,378, filed Jul. 19, 1988, now U.S. Pat. No. 4,899,265; which is a continuation of application Ser. No. 07/034,918, filed Apr. 6, 1987, now abandoned; which is a continuation of application Ser. No. 06/828,729, filed Feb. 11, 1986, now U.S. Pat. No. 4,658,336; which is a continuation of application Ser. No. 06/648,032, filed Sep. 6, 1984, now U.S. Pat. No. 4,577,263.

BACKGROUND OF THE INVENTION

1. Field of the Invention

The field of the present invention relates primarily to flashlights, and in particular, to a miniature hand-held flashlight.

2. Discussion of the Prior Art

Flashlights of varying sizes and shapes are well-known in the art. In particular, certain of such known flashlights utilize two or more dry cell batteries, carried in series in a cylindrical tube serving as a handle for the flashlight, as their source of electrical energy. Typically, an electrical circuit is established from one electrode of the battery through a conductor to a switch, then through a conductor to one electrode of the lamp bulb. After passing through the filament of the lamp bulb, the electrical circuit emerges through a second electrode of the lamp bulb in electrical contact with a conductor, which in turn is in electrical contact with the flashlight housing. The flashlight housing provides an electrical conduction path to an electrical conductor, generally a spring element, in contact with the other electrode of the battery. Actuation of the switch to complete the electrical circuit enables electrical current to pass through the filament, thereby generating light which is typically focused by a reflector to form a beam of light.

The production of light from such flashlights has often been degraded by the quality of the reflector utilized and the optical characteristics of any lens interposed in the beam path. Moreover, intense light beams have often required the incorporation of as many as seven dry cell batteries in series, thus resulting in a flashlight having significant size and weight.

Efforts at improving such flashlights have primarily addressed the quality of the optical characteristics. The production of more highly reflective, well-defined reflectors, which may be incorporated within such flashlights, have been found to provide a more well-defined focus thereby enhancing the quality of the light beau produced. Additionally, several advances have been achieved in the light admitting characteristics of flashlight lamp bulbs.

Since there exists a wide variety of uses for hand-held flashlights, the development of the flashlight having a variable focus, which produces a beam of light having a variable dispersion, has been accomplished. However, such advances have heretofore been directed at "full-sized" flashlights.

SUMMARY OF THE INVENTION

It is a primary object of the present invention to provide a miniature hand-held flashlight having improved optical characteristics.

It is another object of the present invention to provide a miniature hand-held flashlight which is capable of producing a beam of light having a variable dispersion.

It is a further object of the present invention to provide a miniature hand-held flashlight which is capable of supporting itself vertically on a horizon surface to serve as an "ambient" unfocused light source.

It is another object of the present invention to provide a miniature hand-held flashlight wherein relative motions of components that produce the variation and the dispersion of the light beam provide an electrical switch function to open and complete the electrical circuit of the flashlight.

These and other objects of the present invention, which may become obvious to those skilled in the art through the hereinafter detailed description of the invention are achieved by a miniature flashlight comprising: a cylindrical tube containing at least two miniature dry call batteries disposed in a series arrangement, a lamp bulb holder assembly including electrical conductors for making electrical contact between terminals of a miniature lamp held therein and the cylindrical tube and an electrode of the battery, respectively, retained in one end of the cylindrical tube adjacent the batteries, a tail cap and spring member enclosing the other end of the cylindrical tube and providing an electrical contact to the other electrode of the batteries, and a head assembly including a reflector, a lens, and a face cap, which head assembly is rotatably mounted to the cylindrical tube such that the lamp bulb extends through a hole in the center of the reflector within the lens. In the principle embodiment of the present invention, the batteries are of the size commonly referred to as "pen light" batteries.

The head assembly engages threads formed on the exterior of the cylindrical tube such that rotation of a head assembly about the axis of the cylindrical tube will change the relative displacement between the lens and the lamp bulb. When the head assembly is fully rotated onto the cylindrical tube, the reflector pushes against the forward end of the lamp holder assembly causing it to shift rearward within the cylindrical tube against the urging of the spring contact at the tail cap. In this position, the electrical conductor within the lamp holder assembly which completes the electrical circuit from the lamp bulb to the cylindrical tube is not in contact with the tube. Upon rotation of the head assembly in a direction causing the head assembly to move forward with respect to the cylindrical tube, pressure on the forward surface of the lamp holder assembly from the reflector is relaxed enabling the spring contact in the tail cap to urge the batteries and the lamp holder assembly in a forward direction, which brings the electrical conductor into contact with the cylindrical tube, thereby completing the electrical circuit and causing the lamp bulb to illuminate. At this point, the lamp holder assembly engages a stop which prevents further forward motion of the lamp holder assembly with respect to the cylindrical tube. Continued rotation of the head assembly in a direction causing the head assembly to move forward relative to the cylindrical tube causes the reflector to move forward relative to the lamp bulb, thereby changing the focus of the reflector with respect to the lamp bulb, which results in varying the dispersion of the light beam admitted through the lens.

By rotating the head assembly until it disengages from the cylindrical tube, the head assembly may be placed, lens down, on a substantially horizontal surface and the tail cap and cylindrical tube may be vertically inserted therein to provide a miniature "table lamp."

DETAILED DESCRIPTION OF A PREFERRED EMBODIMENT

Figures 1, 2, 3:
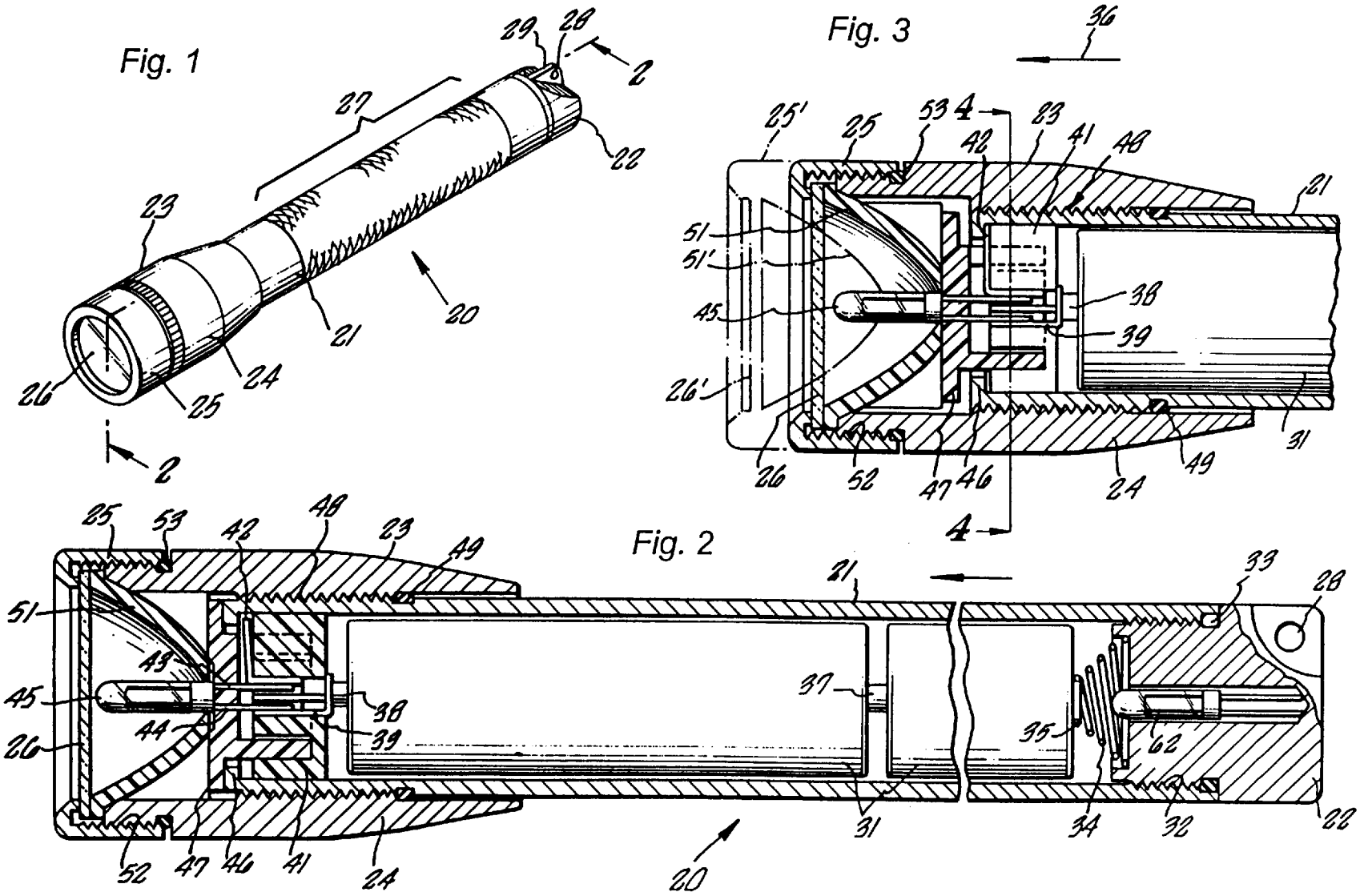
FIG. 1 is a perspective view of a miniature flashlight in accordance with the present invention.
FIG. 2 is a partially foreshortened cross-sectional view of the miniature flashlight of FIG. 1 as taken through the plane indicated by 2—2.
FIG. 3 is a partial cross-sectional view of a forward end of the miniature flashlight, illustrating, in ghost image, a translation of the forward end of the flashlight.

Referring first to FIG. 1, a miniature flashlight in accordance with the present invention is illustrated in perspective generally at 20. The miniature flashlight 20 is comprised of a generally right circular cylinder, or barrel 21, enclosed at a first end by a tail cap 22 and having a head assembly 23 enclosing a second and thereof. The head assembly comprises a head 24 to which is affixed a face cap 25 which retains a lens 26. The head assembly 23 has a diameter greater than that of the barrel 21 and is adapted to pass externally over the exterior of the barrel 21. The barrel 21 may provide a machined handle surface 27 along its axial extent. The tail cap 22 may be configured to include provision for attaching a handling lanyard through a hole 28 in a tab 29 formed therein.

Referring next to FIG. 2, the barrel 21 is seen to have an extent sufficient to enclose at least two miniature dry cell batteries 31 disposed in a series arrangement. The tail cap 22 has a region of external threading 32 which engages matching threads formed on the interior surface of the barrel 21. A sealing element 33, typically in the form of an O-ring, is provided at the interface between the tail cap 22 and the barrel 21 to provide a watertight seal. A spring member 34 is disposed within the barrel 21 so as to make electrical contact with the tail cap 22 and a case electrode 35 of an adjacent battery 31. The spring member 34 also urges the batteries 31 in a direction indicated by an arrow 36. A center electrode 37 of the rearmost battery 31 is in contact with the case electrode of the forward battery 31. The center electrode 38 of the forward battery is urged into contact with a first conductor 39 mounted within a lower insulator receptacle 41. The lower insulator receptacle 41 also has affixed therein a side contact conductor 42. Both the center conductor 39 and the side contact conductor 42 pass through holes formed in the lower insulator receptacle in an axial direction, and both are adapted to frictionally receive and retain the terminal electrodes 43 and 44 of a miniature bi-pin lamp bulb 45. Absent further assembly, the lower insulator receptacle is urged in the direction indicated by the arrow 36, by the action of the spring 34, to move until it comes into contact with a lip 46 formed on the end of the barrel 21. At that point electrical contact is made between the side contact conductor 42 and the lip 46 of the barrel 21.

An upper insulator receptacle 47 is disposed external to the end of the barrel 21 whereat the lower insulator receptacle 41 is installed. The upper insulator receptacle 47 has extensions that are configured to mate with the lower insulator receptacle 41 to maintain an appropriate spacing between opposing surfaces of the upper insulator receptacle 47 and the lower insulator receptacle 41. The lamp electrodes 43 and 44 of the lamp bulb 45 pass through the upper insulator receptacle 47 and into electrical contact with the center conductor 39 and the side contact conductor 42, respectively, while the casing of the lamp bulb 45 rests against an outer surface of the upper insulator receptacle 47.

The head assembly 23 is installed external to the barrel 21 by engaging threads 48 formed on an interior surface of the head 24 engaging with matching threads formed on the exterior surface of the barrel 21. A sealing O-ring 49 is installed around the circumference of the barrel 21 adjacent the threads to provide a water-tight seal between the head assembly 23 and the barrel 21. A substantially parabolic reflector 51 is configured to be disposed within the outermost end of the head 24, whereat it is rigidly hold in place by the lens 26 which is in turn retained by the face cap 25 which is threadably engaged with threads 52 formed on the forward portion of the outer diameter of the head 24. An O-ring 53 nay be incorporated at the interface between the face cap 25 and the head 24 to provide a water-tight seal.

When the head 24 is fully screwed onto the barrel 21 by means of the threads 48, the central portion of the reflector 51 surrounding a hole formed therein for passage of the lamp bulb 45, is forced against the outermost surface of the upper insulator receptacle 47, urging it in a direction counter to that indicated by the arrow 36. The upper insulator receptacle 47 then pushes the lower insulator receptacle 41 in the same direction, thereby providing a space between the forwardmost surface of the lower insulator receptacle 41 and the lip 46 on the forward end of the barrel 21. The side contact conductor 42 is thus separated from contact with the lip 46 on the barrel 21 as is shown in FIG. 2.

Referring next to FIG. 3, appropriate rotation of the head 24 about the axis of the barrel 21 causes the head assembly 23 to move in the direction indicated by the arrow 36 through the engagement of the threads 48. Upon reaching the relative positions indicated in FIG. 3 by the solid lines, the head assembly 23 has progressed a sufficient distance in the direction of the arrow 36 such that the reflector 51 has also moved a like distance, enabling the upper insulator receptacle 47 and the lower insulator receptacle 41 to be moved, by the urging of the spring 34 (FIG. 2) translating the batteries 31 in the direction of the arrow 36, to the illustrated position. In this position, the side contact conductor 42 has been brought into contact with the lip 46 on the forward end of the barrel 21, which closes the electrical circuit.

Further rotation of the head assembly 23 so as to cause further translation of the head assembly 23 in the direction indicated by the arrow 36 will result in the head assembly 23 reaching a position indicated by the ghost image of FIG. 3, placing the face cap at the position 25' and the lens at the position indicated by 26', which in turn carries the reflector 51 to a position 51'. During this operation, the upper insulator receptacle 47 remains in a fixed position relative to the barrel 21. Thus the lamp bulb 45 also remains in a fixed position. The shifting of the reflector 51 relative to the lamp bulb 45 during this additional rotation of the head assembly 23' produces a relative shift in the position of the filament of the lamp bulb 45 with respect to a focus of the parabola of the reflector 51, thereby varying the dispersion of the light beam emanating from the lamp bulb 45 through the lens 26.

Figures 4, 5, 6, 7, 8:
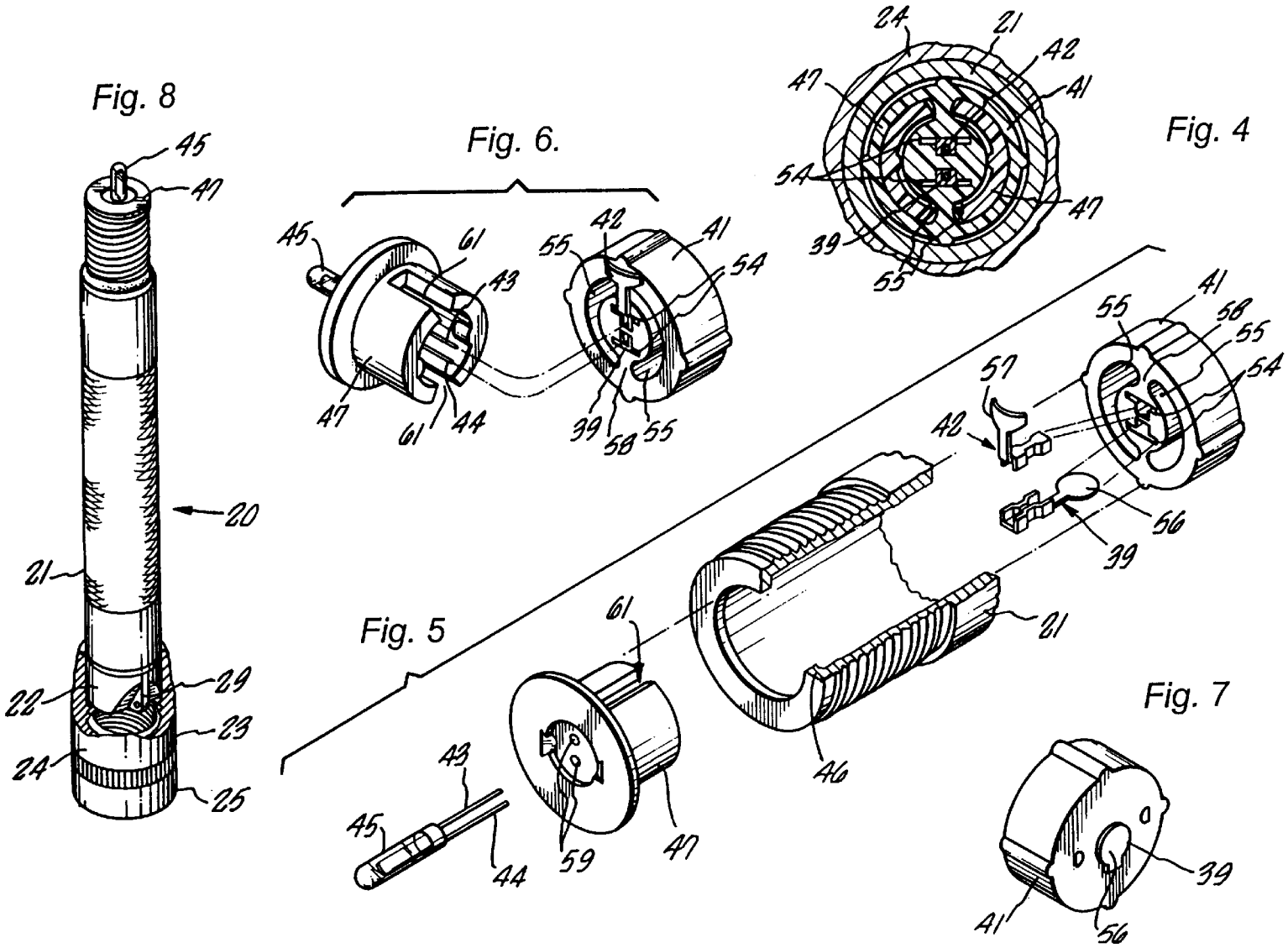
FIG. 4 is a partial cross-sectional view of a lamp bulb holder assembly used in accordance with the present invention, taken along the plane indicated by 4—4 of FIG. 3.
FIG. 5 is an exploded perspective view illustrating the assembly of the lamp bulb holder assembly with respect to a barrel of the miniature flashlight.
FIG. 6 is an isolated partial perspective view illustrating the electro mechanical interface between electrical terminals of the lamp bulb and electrical conductors within the lamp bulb holder.
FIG. 7 presents a perspective view of a rearward surface of the lamp bulb holder of FIG. 5, illustrating a battery electrode contact terminal.
FIG. 8 illustrates an alternate utilization of the miniature flashlight in accordance with the present invention.

Referring next to FIG. 4, a partial cross-sectional view illustrates the interface between the lower insulator receptacle 41 and the upper insulator receptacle 47. The lower insulator receptacle 41 has a pair of parallel slots 54 formed therethrough which are enlarged in their center portion to receive the center conductor 39 and the side contact conductor 42, respectively. A pair of arcuate recesses 55 are formed in the lower insulator receptacle 41 and receive matching arcuate extensions of the upper insulator receptacle 47. The lower insulator receptacle 41 is movably contained within the inner diameter of the barrel 21 which is in turn, at the location of the illustrated cross-section, enclosed within the head 24.

Referring next to FIGS. 5 through 7, a preferred procedure for the assembly of the lower insulator receptacle 41, the center conductor 39, the side contact conductor 42, the upper insulator receptacle 47 and the miniature lamp bulb 45 may be described. Placing the lower insulator receptacle 41 in a position such that the arcuate recesses 55 are directionally oriented towards the forward and of the barrel 21 and the lip 46, the center conductor 39 is inserted through one of the slots 54 such that a substantially circular end section 56 extends outwardly from the rear surface of the lower insulator receptacle 41. The circular end section 56 is then bent, as shown in FIG. 7, to be parallel with the rearmost surface of the lower insulator receptacle 41 in a position centered to match the center electrode of the forwardmost one of the batteries 31 of FIG. 2. The side contact conductor 42 is then inserted into the other slot 54 such that a radial projection 57 extends outwardly from the axial center of the lower insulator receptacle 41. It is to be noted that the radial projection 37 aligns with a web 58 between the two arcuate recesses 55.

The lower insulator receptacle 41, with its assembled conductors, is then inserted in the rearward end of the barrel 21 and is slidably translated to a forward position immediately adjacent the lip 46. The lamp electrodes 43 and 44 are then passed through a pair of holes 59 formed through the forward surface of the upper insulator receptacle 47 so that they project outwardly from the rear surface thereof as illustrated in FIG. 6. The upper insulator receptacle 47, containing the lamp bulb 45, is then translated such that the lamp electrodes 43 and 44 align with receiving portions of the side contact conductor 42 and the center conductor 39, respectively. A pair of notches 61, formed in the upper insulator receptacle 47, are thus aligned with the webs 58 of the lower insulator receptacle 41. The upper insulator receptacle 47 is then inserted into the arcuate recesses 55 in the lower insulator receptacle 41 through the forward end of the barrel 21.

Referring again to FIGS. 2 and 3, the electrical circuit of the miniature flashlight in accordance with the present invention will now be described. Electrical energy is conducted from the rearmost battery 31 through its center contact 37 which is in contact with the case electrode of the forward battery 31. Electrical energy is then conducted from the forward battery 31 through Its center electrode 38 to the center contact 39 which is coupled to the lamp electrode 44. After passing through the lamp bulb 45, the electrical energy emerges through the lamp electrode 43 which is coupled to the side contact conductor 42. When the head assembly 23 has been rotated about the threads 48 to the position illustrated in FIG. 2, the side contact conductor 42 does not contact the lip 46 of the barrel 21, thereby resulting In an open electrical circuit. However, when the head assembly 23 has been rotated about the threads 48 to the position illustrated by the solid lines of FIG. 3, the side contact conductor 42 is pressed against the lip 46 by the lower insulator receptacle 41 being urged in the direction of the arrow 36 by the spring 34 of FIG. 2. In this configuration, electrical energy may then flow from the side contact conductor 42 into the lip 46, through the barrel 21 and into the tall cap 22 of FIG. 2. The spring 34 electrically couples the tall cap 22 to the case electrode 35 of the rearmost battery 31. By rotating the head assembly 23 about the threads 48 such that the head assembly 23 moves in a direction counter to that indicated by the arrow 36, the head assembly 23 may be restored to the position illustrated in FIG. 2, thereby opening the electrical circuit and turning off the flashlight.

Referring next to FIG. 8, an additional utilization of the miniature flashlight 20 in accordance with the present invention is illustrated. By rotating the head assembly 23 about the threads 48 in a direction causing the head assembly 23 to translate relative to the barrel 21 in the direction of the arrow 36 of FIG. 3, the electrical circuit will be closed as previously described, and the lamp bulb 45 will be illuminated. Continued rotation of the head assembly 23 in that direction enables the head assembly 23 to be completely removed from the forward end of the miniature flashlight 20. By placing the head assembly 23 upon a substantially horizontal surface (not illustrated) such that the face cap 25 rests on the surface, the tail cap 22 of the miniature flashlight 20 may be inserted into the head 24 to hold the barrel 21 in a substantially vertical alignment. Since the reflector 51 (FIG. 2) is located within the head assembly 23, the lamp bulb 45 will omit a substantially spherical illumination, thereby providing a "ambient" light level.

In a preferred embodiment, the barrel 21, the tail cap 22, the head 24, and the face cap 25, forming all of the exterior metal surfaces of the miniature flashlight 20 are manufactured from aircraft quality, heat-treated aluminum, which is annodized for corrosion resistance. The sealing O-rings 33, 49, and 53 provide atmospheric sealing of the interior of the miniature flashlight 20 to a depth of 200 feet. All interior electrical contact surfaces are appropriately machined to provide efficient electrical conduction. The reflector 51 is a computer generated parabola which is vacuum aluminum metallized to ensure high precision optics. The threads 48 between the head 24 and the barrel 31 are machined such that revolution of the head assembly 23 through less than ¼ turn will close the electrical circuit, turning the flashlight on, and an additional ¼ turn will adjust the light beam from a "spot" to a "soft flood". A spare lamp bulb 62 may be provided in a cavity machined in the tail cap 22.

While I have described a preferred embodiment of the herein invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

I claim:

1. A flashlight powered by at least one battery, comprising:

a barrel for retaining one or more batteries, said barrel having first and second ends;

a lamp bulb positioned at the first end of said barrel;

a head assembly removably mounted on the first end of said barrel for retaining a reflector and a lens in a mutually fixed relationship, said head assembly being controllably translatable along said barrel in response to rotation thereof with respect to said barrel;

a tail cap at said second end of said barrel;

wherein relative motion of said head assembly in the axial direction away from said barrel separates said head assembly from said barrel to expose said lamp bulb and provide for a dispersion of light when said head assembly is removed from said barrel, and said head assembly is adapted to receive said tail cap when said head assembly is removed from said barrel.

2. A flashlight powered by at least one battery, comprising:

a barrel for retaining one or more batteries, said barrel having first and second ends;

a lamp bulb positioned at the first end of said barrel;

a head assembly removably mounted on the first end of said barrel, said head assembly including a reflector and a lens in a mutually fixed relationship;

a tail cap at said second end of said barrel;

wherein said head assembly is adapted to receive said tail cap and generally support said barrel in a vertical position when said head assembly is removed from the first end of said barrel.

3. A flashlight according to claim 2, wherein said head assembly is adapted to receive said tail cap and a portion of said barrel and generally support said barrel in a vertical position when said head assembly is removed from the first end of said barrel.

4. A flashlight powered by at least one battery, comprising:

a barrel for retaining one or more batteries, the barrel having first and second ends;

a lamp bulb positioned at the first end of the barrel;

a head assembly removably mounted on the first end of the barrel for retaining a reflector and a lens in a mutually fixed relationship, the head assembly being controllably translatable along the barrel in response to rotation thereof with respect to the barrel;

a tail cap at the second end of the barrel;

wherein relative motion of the head assembly in the axial direction away from the barrel separates the head assembly from the barrel and wherein the tail cap may be inserted into the head assembly when the head assembly is removed from the barrel to hold the barrel in a substantially vertical position when the head assembly is placed on a horizontal surface.

5. A flashlight according to claim 4, wherein the tail cap and a portion of the barrel may be inserted into the head assembly when the head assembly is removed from the barrel to hold the barrel in a substantially vertical position when the head assembly is placed on a horizontal surface.

6. A flashlight, comprising:

a barrel assembly for retaining at least one battery, the barrel assembly having a first end including threads;

a head assembly including a lens and a reflector having a central opening, the head assembly being removably coupled to the first end of the barrel assembly and rotatable relative to the barrel assembly along the threads wherein rotation of the head assembly effects movement of the head assembly along the threads and axially along the barrel assembly;

a lamp bulb adjacent to the head assembly and positioned to extend through the central opening, the lamp bulb including a first contact, a second contact, and a filament connecting the first and second contacts;

a first electrical path for coupling the first contact of the lamp bulb with at least one battery retained by the barrel assembly; and a second electrical path for coupling the second contact of the lamp bulb with at least one battery retained by the barrel assembly when the head assembly is rotated relative to the barrel assembly along the threads, thereby completing the electrical circuit of the flashlight but without conduction through the head assembly, and for uncoupling the second contact of the lamp bulb with at least one battery retained by the barrel assembly when the head assembly is rotated relative to the barrel assembly in the opposite direction along the threads.

7. A flashlight comprising:

a barrel for retaining one or more batteries, said barrel having first and second ends;

a lamp bulb positioned at the first end of said barrel;

a substantially parabolic reflector having a central opening therein adapted to receive said lamp bulb;

a substantially planar lens;

a head assembly at one end of said barrel for retaining said reflector and said lens in a mutually fixed relationship, said head assembly being controllably translatable along said barrel in response to rotation thereof with respect to said barrel;

a tail cap at said other end of said barrel;

wherein relative motion of said head assembly in the axial direction away from said barrel separates said head assembly from said barrel to expose said lamp bulb and provide for a dispersion of light when said head assembly is removed from said barrel, and said head assembly is adapted to receive said tail cap when said head assembly is removed from said barrel.

8. A flashlight according to claim 7, wherein said head assembly is adapted to receive said tail cap and a portion of said barrel when said head assembly is removed.

9. A flashlight powered by at least one battery, comprising:

a barrel for retaining the at least one battery, said barrel having first and second ends;

a lamp bulb;

a substantially parabolic reflector having a central opening therein adapted to receive said lamp bulb;

a substantially planar lens;

a head assembly at one end of said barrel for retaining said reflector and said lens in a mutually fixed relationship, said head assembly being controllably translatable along said barrel in response to rotation thereof with respect to said barrel to cause relative motion between said lamp bulb and said reflector and provide for a varying dispersion of light during operation of the flashlight;

wherein relative motion of said head assembly in an axial direction away from said barrel activates said lamp bulb and continued relative motion of said head assembly in the axial direction away from said barrel separates said head assembly from said barrel to expose said lamp bulb and provide for a substantially spherical dispersion of light and said removed head assembly is adapted to receive said other end of said barrel and support the flashlight.

10. A flashlight powered by at least one battery, comprising:

a barrel for retaining the at least one battery, said barrel having first and second ends;

a lamp bulb;

a substantially parabolic reflector having a central opening therein adapted to receive said lamp bulb;

a substantially planar lens;

a head assembly at one end of said barrel for retaining said reflector and said lens in a mutually fixed relationship, said head assembly being controllably translatable along said barrel in response to rotation thereof with respect to said barrel to cause relative motion between the lamp bulb and the reflector and provide for a varying dispersion of light during operation of the flashlight;

wherein rotation of said head assembly to cause said head assembly to move in the axial direction toward said barrel switches said lamp bulb off and rotation of said head assembly to cause said head assembly to move in the axial direction away from said barrel switches the lamp bulb on and continued rotation of said head assembly to cause said head assembly to move in the axial direction away from said barrel separates said head assembly from said barrel to expose said lamp bulb and provide for a substantially spherical dispersion of light.

11. A flashlight powered by at least one battery, comprising:

a barrel assembly for retaining one or more batteries, the barrel assembly having a first end including threads;

a reflector having a central opening;

a substantially planar lens;

a head assembly, adjacent to the reflector and the lens, the head assembly being removably coupled to the first end of the barrel assembly and rotatable relative to the barrel assembly along the threads wherein rotation of the head assembly effects movement of the head assembly along the threads and axially along the barrel assembly;

a lamp bulb positioned to extend through the central opening of the reflector, the lamp bulb including a first contact, a second contact, and a filament connecting the first and second contacts;

a first electrical path for coupling the first contact of the lamp bulb with at least one battery retained by the barrel assembly; and a second electrical path for coupling the second contact of the lamp bulb with at least one battery retained by the barrel assembly when the head assembly is rotated relative to the barrel assembly along the threads, thereby completing the electrical circuit for the flashlight but without conduction through the head assembly, and for uncoupling the second contact of the lamp bulb with at least one battery retained by the barrel assembly when the head assembly is rotated relative to the barrel assembly in the opposite direction along the threads.

12. A flashlight powered by at least one battery, comprising:

a barrel assembly for retaining a battery source of power, said barrel assembly having a first end including threads;

a lamp bulb adjacent to said battery source of power;

a head assembly, said head assembly being removably coupled to the first end of said barrel assembly along the threads wherein rotation of said head assembly effects movement of said head assembly along the threads and axially along said barrel assembly;

a switch responsive to axial movement of said head assembly to close an electrical path between said lamp bulb and said battery source of power and responsive to axial movement of said head assembly in the opposite direction to open said electrical path between said lamp bulb and said battery source of power, said switch including a first and second electrical contact in said path, the first of said contacts being stationary, and the second of said contacts being axially movable into and out of electrical contact with said first electrical contact to close and open said switch in response to rotation of said head assembly.

13. A flashlight, comprising:

a barrel assembly for retaining at least one battery, the barrel assembly having a first end including threads;

a light source positioned at the first end of the barrel assembly, the light source including a first contact and a second contact;

a head assembly, including a lens, the head assembly being adapted to receive the light source and being removably coupled to the first end of the barrel assembly and rotatable relative to the barrel assembly along the threads wherein rotation of the head assembly effects movement of the head assembly along the threads and axially along the barrel assembly;

a first electrical path for coupling the first contact of the light source with at least one battery retained by the barrel assembly; and a second electrical path for coupling the second contact of the light source with at least one battery retained by the barrel assembly when the head assembly is rotated relative to the barrel assembly along the threads, thereby completing the electrical circuit of the flashlight but without conduction through the head assembly, and for uncoupling the second contact of the lamp bulb with at least one battery retained by the barrel assembly when the head assembly is rotated relative to the barrel assembly in the opposite direction along the threads.

14. A flashlight according to claim 13, wherein rotation of the head assembly to cause the head assembly to move in an axial direction away from the barrel assembly switches the light source on, and rotation of the head assembly to cause the head assembly to move in an axial direction toward the barrel assembly switches the light source off.

15. A flashlight powered by at least one battery, comprising:

a barrel assembly for retaining a battery source of power, the barrel assembly having a first end including threads;

a light source positioned at the first end of the barrel assembly;

a head assembly, the head assembly being adapted to receive the light source and being removably coupled to the first end of the barrel assembly and rotatable relative to the barrel assembly along the threads wherein rotation of the head assembly effects movement of the head assembly along the threads and axially along the barrel assembly;

a switch responsive to axial movement of the head assembly to close an electrical path between the light source and the battery source of power and responsive to axial movement of the head assembly in the opposite direction to open the electrical path between the light source and the battery source of power, the switch including a first and second electrical contact in said path, the first of the contacts being stationary, and the second of the contacts being axially movable into and out of electrical contact with the first electrical contact to close and open the switch in response to rotation of the head assembly.

16. A flashlight according to claim 15, wherein rotation of the head assembly to cause the head assembly to move in an axial direction away from the barrel assembly switches the light source on, and rotation of the head assembly to cause the head assembly to move in an axial direction toward the barrel assembly switches the light source off.

* * * * *

UNITED STATES PATENT AND TRADEMARK OFFICE

CERTIFICATE OF CORRECTION

PATENT NO. : 6,170,960 B1
DATED : January 9, 2001
INVENTOR(S) : Anthony Maglica

It is certified that error appears in the above-identified patent and that said Letters Patent is hereby corrected as shown below:

Column 1,
Line 60, change "beau" to read -- beam --.

Column 4,
Line 30, change "hold" to read -- held --.
Line 34, change "nay" to read -- may --.

Column 5,
Line 31, change "and" to read -- end --.
Line 43, change "37" to read -- 57 --.
Line 67, change "Its" to read -- its --.

Column 6,
Line 7, change "In" to read -- in --.
Line 15, change "tall" to read -- tail --.
Line 16, change "tall" to read -- tail --.

Signed and Sealed this

Twenty-sixth Day of March, 2002

*Attest:*

*Attesting Officer*

JAMES E. ROGAN
*Director of the United States Patent and Trademark Office*

US006170960C1

(12) EX PARTE REEXAMINATION CERTIFICATE (5354th)

United States Patent

Maglica

(10) Number: US 6,170,960 C1

(45) Certificate Issued: *Apr. 18, 2006

(54) MINIATURE FLASHLIGHT

(75) Inventor: Anthony Maglica, Ontario, CA (US)

(73) Assignee: MAG Instrument, Inc., Ontario, CA (US)

Reexamination Request:
No. 90/006,233, Mar. 1, 2002

Reexamination Certificate for:

| | |
|---|---|
| Patent No.: | **6,170,960** |
| Issued: | **Jan. 9, 2001** |
| Appl. No.: | **09/305,499** |
| Filed: | **May 5, 1999** |

( * ) Notice: This patent is subject to a terminal disclaimer.

Certificate of Correction issued Mar. 26, 2002.

Related U.S. Application Data

(63) Continuation of application No. 09/064,468, filed on Apr. 22, 1998, now abandoned, which is a continuation of application No. 08/514,715, filed on Aug. 14, 1995, now Pat. No. 5,806,964, which is a continuation of application No. 08/136,349, filed on Oct. 14, 1993, now abandoned, which is a continuation of application No. 07/938,626, filed on Sep. 1, 1992, now Pat. No. 5,293,307, which is a continuation of application No. 07/809,846, filed on Dec. 18, 1991, now Pat. No. 5,143,441, which is a continuation of application No. 07/553,977, filed on Jul. 16, 1990, now abandoned, which is a continuation of application No. 07/356,361, filed on May 23, 1989, now Pat. No. 4,942,505, which is a continuation of application No. 07/222,378, filed on Jul. 18, 1988, now Pat. No. 4,899,265, which is a continuation of application No. 07/034,918, filed on Apr. 6, 1987, now abandoned, which is a continuation of application No. 06/828,729, filed on Feb. 11, 1986, now Pat. No. 4,658,336, which is a continuation of application No. 06/648,032, filed on Sep. 6, 1984, now Pat. No. 4,577,263.

(51) Int. Cl.
*F21L 4/00* (2006.01)

(52) U.S. Cl. ..... 362/205; 362/187

(58) Field of Classification Search ..... 362/205, 362/187, 204
See application file for complete search history.

(56) References Cited

U.S. PATENT DOCUMENTS 1,591,627 A 7/1926 Hopkins (Continued)

FOREIGN PATENT DOCUMENTS

FR 76-36421 6/1976

(Continued)

OTHER PUBLICATIONS

*Mag Instrument, Inc.* v. *Dollar Tree Stores, Inc., et al.*, U.S. District Court, Central District of California, Case No. 03–6215 RSWL (SHx)—Complaint for Infringement, Federal Trademark Infringement, Federal and State Trademark Dilution, Federal and State Unfair Competition, and Unauthorized Infringement of a Trademark to Enhance Commercial Value of Product.

(Continued)

*Primary Examiner*—Thomas M Sember

(57) ABSTRACT

A miniature flashlight comprising a barrel, tailcap, head, bulb holder, bulb and an electrical circuit. The bulb holder is positioned at one end of the barrel such that the bulb extends into the head. The head includes a parabolic reflector surrounding the bulb such that the rotation of the head relative to the barrel changes the focus of the flashlight beam. A rotary switch associates the bulb holder with the barrel to control opening and closing of the electrical circuit. Rotation of the head away from the barrel closes the electrical circuit. The head is not a part of the electrical circuit and its removal exposes the bulb for substantially spherical illumination. The head assembly is removable from the barrel for use as a base into which the tailcap is inserted to stand the miniature flashlight in its "on" condition, as a lamp.

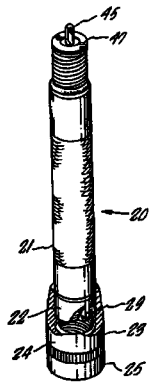

U.S. PATENT DOCUMENTS

| | | | | |
|---|---|---|---|---|
| 2,123,491 | A | 7/1938 | Williams | 240/10.68 |
| 2,272,907 | A | 2/1942 | Deibel | 240/10.61 |
| 4,203,150 | A | 5/1980 | Shamlian | 362/183 |
| 4,234,913 | A | 11/1980 | Ramme | 362/158 |
| 4,429,351 | A | 1/1984 | Petzl et al. | 362/187 |
| 4,472,766 | A | 9/1984 | Hung | 362/158 |
| 4,531,178 | A | 7/1985 | Uke | 362/158 |

FOREIGN PATENT DOCUMENTS

| | | |
|---|---|---|
| GB | 549104 | 11/1942 |
| GB | 752619 | 7/1956 |
| GB | 812980 | 5/1957 |

OTHER PUBLICATIONS

*Mag Instrument, Inc.* v. *Dollar Tree Stores, Inc., et al.,* U.S. District Court, Central District of California, Case No. 03–6215 RSWL (SHx)—Demand for Jury Trial; Second Amended Answer and Counterclaims of Defendant Dollar Tree Stores, Inc. and Dollar Tree Distribution, Inc.

*Mag Instrument, Inc.* v. *Dollar Tree Stores, Inc., et al.,* U.S. District Court, Central District of California, Case No. 03–6215 RSWL (SHx)—Mag Instrument, Inc.'s Reply to Second Amended Answer and Counterclaims of Defendant Dollar Tree Stores, Inc. and Dollar Tree Distribution, Inc.; Demand for Jury Trial.

*Mag Instrument, Inc.* v. *Dollar Tree Stores, Inc., et al.,* U.S. District Court, Central District of California, Case No. 03–6215 RSWL (SHx)—Expert Report of Martin J. Siegel, P.E.

*Mag Instrument, Inc.* v. *Dollar Tree Stores, Inc., et al.,* U.S. District Court, Central District of California, Case No. 03–6215 RSWL (SHx)—Expert Report of Michael C. Thuma.

*Mag Instrument, Inc.* v. *Dollar Tree Stores, Inc., et al.,* U.S. District Court, Central District of California, Case No. 03–6215 RSWL (SHx)—Martin J. Siegel P.E.'s Rebuttal Report to Report of Michael C. Thuma.

*Mag Instrument, Inc.* v. *Dollar Tree Stores, Inc., et al.,* U.S. District Court, Central District of California, Case No. 03–6215 RSWL (SHx)—Dollar Tree Stores, Inc.'s and Dollar Tree Distribution, Inc.'s Supplemental Responses to Nos. 4, 5 and 7 of Plaintiff Mag Instrument, Inc.'s First Set of Interrogatories.

*Mag Instrument, Inc.* v. *Dollar Tree Stores, Inc., et al.,* U.S. District Court, Central District of California, Case No. 03–6215 RSWL (SHx)—Mag Instrument, Inc.'s Response to Dollar Tree Distribution, Inc.'s First Set of Interrogatories.

*Mag Instrument, Inc.* v. *Dollar Tree Stores, Inc., et al.,* U.S. District Court, Central District of California, Case No. 03–6215 RSWL (SHx)—Memorandum of Points and Authorities in Support of Motion for Summary Judgment Dismissing Certain Affirmative Defenses and Counterclaims and for Summary Adjudication of Certain Facts.

*Mag Instrument, Inc.* v. *Dollar Tree Stores, Inc., et al.,* U.S. District Court, Central District of California, Case No. 03–6215 RSWL (SHx)—Declaration of Charles E. Van Horn in Support of Motion for Summary Judgment Dismissing Certain Affirmative Defenses and Counterclaims and for Summary Adjudication of Certain Facts.

*Mag Instrument, Inc.* v. *Dollar Tree Stores, Inc., et al.,* U.S. District Court, Central District of California, Case No. 03–6215 RSWL (SHx)—Declaration of Jerrold B. Reilly in Support of Motion of Summary Judgment Dismissing Certain Affirmative Defenses and Counterclaims and for Summary Adjudication of Certain Facts.

*Mag Instrument, Inc.* v. *Dollar Tree Stores, Inc., et al.,* U.S. District Court, Central District of California, Case No. 03–6215 RSWL (SHx)—Statement of Uncontroverted Facts and Conclusions of Law Re: Motion for Summary Judgment Dismissing Certain Affirmative Defenses and Counterclaims and for Summary Adjudication of Certain Facts.

*Mag Instrument, Inc.* v. *Dollar Tree Stores, Inc., et al.,* U.S. District Court, Central District of California, Case No. 03–6215 RSWL (SHx)—Court's Order Pursuant to F.R.Civ.P. 56.

*Mag Instrument, Inc.* v. *Dollar Tree Stores, Inc., et al.,* U.S. District Court, Central District of California, Case No. 03–6215 RSWL (SHx)—Court's Order Pursuant to F.R.Civ.P. 56(d).

*Mag Instrument, Inc.* v. *Dollar Tree Stores, Inc., et al.,* U.S. District Court, Central District of California, Case No. 03–6215 RSWL (SHx)—Memorandum of Points and Authorities in Support of Mag Instrument, Inc.'s Motion for Summary Judgment of Infringement of U.S. Patent Nos. 4,577,263, 4,658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Declaration of Martin J. Siegel P.E. in Support of Mag Instrument, Inc.'s Motion for Summary Judgment of Infringement of U.S. Patent Nos. 4,577,263, 4,658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Declaration of James Zecchini in Support of Mag Instrument, Inc.'s Motion for Summary Judgment of Infringement of U.S. Patent Nos. 4,577,263, 4,658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Declaration of Vilai Serechittma in Support of Mag Instrument, Inc.'s Motion for Summary Judgment of Infringement of U.S. Patent Nos. 4,577,263, 4,658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Declaration of Mary A. Tuck in Support of Mag Instrument, Inc.'s Motion for Summary Judgment of Infringement of U.S. Patent Nos. 4,577,263, 4,658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Dollar Tree Stores, Inc.'s and Dollar Tree Distribution's Memorandum of Points and Authorities in Opposition to Mag's Motion for Summary Judgment of Infringement of U.S. Patent Nos: 6,170,960; 4,942,505; 4,899,265; 4,658,336; and 4,577,263.

*Mag Instrument, Inc.* v. *Dollar Tree Stores, Inc., et al.,* U.S. District Court, Central District of California, Case No. 03–6215 RSWL (SHx)—Declaration of Michael C. Thuma in Support of Defendants' Opposition to Plaintiff's Motion for Summary Judgment of Infringement of U.S. Patent Nos. 6,170,960; 4,942,505; 4,899,265; 4,658,336; and 4,557,263.

*Mag Instrument, Inc.* v. *Dollar Tree Stores, Inc., et al.,* U.S. District Court, Central District of California, Case No. 03–6215 RSWL (SHx)—Dollar Tree Store, Inc.'s and Dollar Tree Distribution's Statement of Genuine Issues, Additional Uncontroverted Facts, and Conclusions of Law in Opposition to Mag's Statement of Uncontroverted Facts and Conclusions of Law for Summary Adjudication on Infringement of U.S. Patent Nos. 4,577,263; 4,658,336; 4,899,265; 4,942,505; and 6,170,960.

*Mag Instrument, Inc.* v. *Dollar Tree Stores, Inc., et al.,* U.S. District Court, Central District of California, Case No. 03–6215 RSWL (SHx)—Declaration of James W. Doroshow in Support of Defendant's Response to Plaintiff's Statement of Uncontroverted Facts, and Conclusions of Law in Opposition to Mag's Statement of Uncontroverted Facts and Conclusions of Law in Support of Mag's Motion for Summary Judgment of Infringement of U.S. Patent Nos. 4,577,263; 4,658,336; 4,899,265; 4,942,505; and 6,170,960.

*Mag Instrument, Inc.* v. *Dollar Tree Stores, Inc., et al.,* U.S. District Court, Central District of California, Case No. 03–6215 RSWL (SHx)—Reply in Support of Mag Instrument, Inc.'s Motion for Summary Judgment of Infringement of U.S. Patent Nos. 4,577,263, 4,658,336, 4899,265, 4,942, 505 and 6,170,960.

*Mag Instrument, Inc.* v. *Dollar Tree Stores, Inc., et al.,* U.S. District Court, Central District of California, Case No. 03–6215 RSWL (SHx)—Reply Declaration of Mary A. Tuck in Support of Mag Instrument, Inc.'s Motion for Summary Judgment of Infringement of U.S. Patent Nos. 4,577,263, 4658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Reply Declaration of Martin J. Siegel P.E. in Support of Mag Instrument, Inc.'s Motion for Summary Judgment of Infringement of U.S. Patent Nos. 4,577,263, 4658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Mag Instrument, Inc.'s Statement of Uncontroverted Facts and Conclusions of Law in Support of Motion for Summary Judgment of Infringement of U.S. Patent Nos. 4,577,263, 4658,336, 4899,265, 4,942,505 and 6,170,960.

*Mag Instrument, Inc.* v. *Dollar Tree Stores, Inc., et al.,* U.S. District Court, Central District of California, Case No. 03–6215 RSWL (SHx)—Court's Order Pursuant to F.R.Civ.P. 56 Re Infringement of U.S. Patent Nos. 4,577, 263, 4,658,336, 4,899,265, 4942,505 and 6,170,960.

*Mag Instrument, Inc.* v. *Dollar Tree Stores, Inc., et al.,* U.S. District Court, Central District of California, Case No. 03–6215 RSWL (SHx)—Memorandum of Points and Authorities in Support of Defendants' Motion for Summary Judgment on Issue of Noninfringement.

*Mag Instrument, Inc.* v. *Dollar Tree Stores, Inc., et al.,* U.S. District Court, Central District of California, Case No. 03–6215 RSWL (SHx)—Declaration of James E. Doroshow in Support of Dollar Tree Stores, Inc.'s and Dollar Tree Distribution, Inc.'s Motion for Summary Adjudication on Issue of Noninfringement.

*Mag Instrument, Inc.* v. *Dollar Tree Stores, Inc., et al.,* U.S. District Court, Central District of California, Case No. 03–6215 RSWL (SHx)—Declaration of Michael C. Thuma in Support of Defendants' Motion for Partial Summary Judgment of Non–Infringement of U.S. Patent Nos. 4,557, 263; 4,656,565; 4,851,974; 4,942,505; 5,143,441; and 6,170,960.

*Mag Instrument, Inc.* v. *Dollar Tree Stores, Inc., et al.,* U.S. District Court, Central District of California, Case No. 03–6215 RSWL (SHx)—Statement of Uncontroverted Facts and Conclusions of Law in Support of Defendants' Motion for Summary Judgment on Issue of Noninfringement.

*Mag Instrument, Inc.* v. *Dollar Tree Stores, Inc., et al.,* U.S. District Court, Central District of California, Case No. 03–6215 RSWL (SHx)—Mag Instrument, Inc.'s Opposition to Defendants' Motion for Summary Judgment of Infringement.

*Mag Instrument, Inc.* v. *Dollar Tree Stores, Inc., et al.,* U.S. District Court, Central District of California, Case No. 03–6215 RSWL (SHx)—Declaration of Mary A. Tuck in Support of Mag Instrument, Inc.'s Opposition to Dollar Tree Stores, Inc. and Dollar Tree Distribution, Inc.'s Motion for Summary Judgment of Noninfringement.

*Mag Instrument, Inc.* v. *Dollar Tree Stores, Inc., et al.,* U.S. District Court, Central District of California, Case No. 03–6215 RSWL (SHx)—Declaration of Martin J. Siegel P.E. in Support of Mag Instrument, Inc.'s Opposition to Defendants' Motion for Partial Summary Judgment of Noninfringement of U.S. Patent Nos. 4,577,263, 4,656,565, 4,581, 974, 4,942,505, 5,143,441 and 6,170,960.

*Mag Instrument, Inc.* v. *Dollar Tree Stores, Inc., et al.,* U.S. District Court, Central District of California, Case No. 03–6215 RSWL (SHx)—Declaration of Martin J. Siegel P.E. in Support of Mag Instrument, Inc.'s Opposition to Defendants' Motion for Partial Summary Judgment of Noninfringement of U.S. Patent Nos. 4,577,263, 4,656,565, 4,581, 974, 4,942,505, 5,143,441 and 6,170,960.

*Mag Instrument, Inc.* v. *Dollar Tree Stores, Inc., et al.,* U.S. District Court, Central District of California, Case No. 03–6215 RSWL (SHx)—Mag Instrument, Inc.'s Statement of Genuine Issues Re Dollar Tree Stores, Inc. and Dollar Tree Distribution, Inc.'s Motion for Summary Judgment on Issue of Noninfringement.

Court Docket Sheet as of Mar. 23, 2005, for *Mag Instrument, Inc.* v. *Dollar Tree Stores, Inc., et al.,* U.S. District Court, Central District of California, Case No. 03–6215 RSWL (SHx).

*Mag Instrument, Inc.* v. *Garrity Industries, Inc.,* U.S. District Court, Central District of California, Case No. 03–00253 RT (SGLx)—Consent Judgment and Injunction, entered Nov. 4, 2003.

*Mag Instrument, Inc.* v. *Illinois Industrial Tool, Inc., et al.,* U.S. District Court, Central District of California, Case No. 03–0768 VAP (SGLx)—Consent Judgment and Injunction (Illinois Industrial Tool, Inc.), entered May 25, 2004.

*Mag Instrument, Inc.* v. *Powertech, Inc.,* U.S. District Court, Central District of California, Case No. 03–6224 GHK (JWJx)—Consent Judgment and Permanent Injunction, entered Apr. 21, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Travis Asbery), filed on Feb. 3, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Brazos Distributors, Inc.), filed Feb. 4, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Claretta Web, dba GroupGlobal.Net Corporation), entered Mar. 3, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Bubco, Inc. dba Intrepid Business Solutions), entered Mar. 3, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Daniel J. Thaens dba Now Network Stores), entered Mar. 11, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Northern Utah Financial Group, Inc.), lodged with the Court on Mar. 23, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Focus Creations), lodged with the Court on Mar. 25, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and Kejo Limited Company), lodged with the Court on Apr. 6, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction Between Mag Instrument, Inc. and Rick Wilki, an individual, dba Second Chance Web Ventures, dba Lots of Gifts, filed May 19, 2004.

*Mag Instrument, Inc.* v. *B & F Systems, Inc., et al.,* U.S. District Court, Central District of California, Case No. CV 03–7760 PA (FMOx)—Default Judgment and Permanent Injunction Against Jeffrey Lim, an individual, dba Cheapster, entered May 26, 2004.

*Mag Instrument, Inc.* v. *B & F Systems, Inc., et al.,* U.S. District Court, Central District of California, Case No. CV 03–7760 PA (FMOx)—Consent Judgment and Permanent Injunction (Between Mag Instrument and B & F System, Inc.), entered Aug. 12, 2004.

*Mag Instrument, Inc.* v. *Advantage Line dba Advantage Industries, et al.,* U.S. District Court, Central District of California, Case No. CV 03–7848 RGK (Mcx)—Consent Judgment and Permanent Injunction, entered Jan. 6, 2005.

*Mag Instrument, Inc.* v. *ATD Tools, Inc., et al.,* U.S. District Court, Central District of California, Case No. CV 03–1306 RT (SGLx)—Consent Judgment and Permanent Injunction, filed Oct. 1, 2004.

*Mag Instrument, Inc.* v. *Imprinted Products, Inc., dba Precision Products Printed, et al.,* U.S. District Court, Central District of California, Case No. CV 04–7863 AHM (VBKx)—Consent Judgment and Permanent Injunction, filed Jan. 26, 2005.

*Mag Instrument, Inc.* v. *Nordic Technologies, Inc.,* U.S. District Court, Central District of California, Case No. 00–11265 MMM (MANx)—Defendant's Second Amended Answer To Plaintiff's First Amended Complaint, Affirmative Defenses and Counterclaims With Demand For Jury Trial.

*Mag Instrument, Inc.* v. *Nordic Technologies, Inc.,* U.S. District Court, Central District of California, Case No. 00–11265 MMM (MANx)—Plaintiff Mag Instrument, Inc.'s Reply to Defendant's Counterclaims in Defendant's Second Amended Answer To Plaintiff's First Amended Complaint.

*Mag Instrument, Inc.* v. *Nordic Technologies, Inc.,* U.S. District Court, Central District of California, Case No. 00–11265 MMM (MANx)—Plaintiff Mag Instrument, Inc.'s Notice of Motion and Motion to Dismiss Defendant Nordic Technologies, Inc.'s Counterclaim for Inequitable Conduct Re the '960 Patent and Motion to Strike Defendant Nordic Technologies, Inc.'s Fourth Affirmative Defense.

*Mag Instrument, Inc.* v. *Nordic Technologies, Inc.,* U.S. District Court, Central District of California, Case No. 00–11265 MMM (MANx)—Memorandum of Points and Authorities in Support of Plaintiff Mag Instrument, Inc.'s Motion to Dismiss Defendant Nordic Technologies, Inc.'s Counterclaim for Inequitable Conduct Re the '960 Patent and Motion to Strike Defendant Nordic Technologies, Inc.'s Fourth Affirmative Defense.

*Mag Instrument, Inc.* v. *Nordic Technologies, Inc.,* U.S. District Court, Central District of California, Case No. 00–11265 MMM (MANx)—Declaration of Mary A. Tuck in Support of Plaintiff Mag Instrument, Inc.'s Motion to Dismiss Defendant Nordic Technologies, Inc.'s Counterclaim for Inequitable Conduct Re the '960 Patent and Motion to Strike Defendant Nordic Technologies, Inc.'s Fourth Affirmative Defense.

*Mag Instrument, Inc.* v. *Nordic Technologies, Inc.,* U.S. District Court, Central District of California, Case No. 00–11265 MMM (MANx)—Defendant's Opposition to Plaintiff's Motion to Dismiss Defendant's Counterclaim For Inequitable Conduct Re: The '960 Patent.

*Mag Instrument, Inc.* v. *Nordic Technologies, Inc.,* U.S. District Court, Central District of California, Case No. 00–11265 MMM (MANx)—Declaration of Robert E. Aycock in Opposition to Plaintiff's Motion to Dismiss Defendant's Counterclaim For Inequitable Conduct Re: the '960 Patent.

*Mag Instrument, Inc.* v. *Nordic Technologies, Inc.,* U.S. District Court, Central District of California, Case No. 00–11265 MMM (MANx)—Reply Re Plaintiff Mag Instrument, Inc.'s Motion to Dismiss Defendant Nordic Technologies, Inc.'s Counterclaim for Inequitable Conduct Re the '960 Patent and Motion to Strike Defendant Nordic Technologies, Inc.'s Fourth Affirmative Defense.

*Mag Instrument, Inc.* v. *Nordic Technologies, Inc.,* U.S. District Court, Central District of California, Case No. 00–11265 MMM (MANx)—Declaration of Mary A. Tuck in Support in Reply Re Plaintiff Mag Instrument, Inc.'s Motion to Dismiss Defendant Nordic Technologies, Inc.'s Counterclaim for Inequitable Conduct Re the '960 Patent and Motion to Strike Defendant Nordic Technologies, Inc.'s Fourth Affirmative Defense.

*Mag Instrument, Inc.* v. *Nordic Technologies, Inc.,* U.S. District Court, Central District of California, Case No. 00–11265 MMM (MANx)—Defendant Nordic Technologies, Inc.'s Notice of Motion and Motion for Leave to File an Amended Answer and Counterclaim to the Complaint of Plaintiff Mag Instrument, Inc.

*Mag Instrument, Inc.* v. *Nordic Technologies, Inc.,* U.S. District Court, Central District of California, Case No. 00–11265 MMM (MANx)—Defendant Nordic Technologies, Inc.'s Memorandum of Points and Authorities in Support of its Motion for Leave to File an Amended Answer and Counterclaim to the Complaint of Plaintiff Mag Instrument, Inc.

*Mag Instrument, Inc.* v. *Nordic Technologies, Inc.,* U.S. District Court, Central District of California, Case No. 00–11265 MMM (MANx)—Declaration of L. David Griffin in Support of Defendant Nordic Technologies, Inc.'s Motion for Leave to File an Amended Answer and Counterclaim to the Complaint of Plaintiff Mag Instrument, Inc.

*Mag Instrument, Inc.* v. *Nordic Technologies, Inc.,* U.S. District Court, Central District of California, Case No. 00–11265 MMM (MANx)—Mag Instrument, Inc.'s Opposition to Nordic Technologies Inc.'s Motion for Leave to File an Amended Answer and Counterclaim.

*Mag Instrument, Inc.* v. *Nordic Technologies, Inc.,* U.S. District Court, Central District of California, Case No. 00–11265 MMM (MANx)—Declaration of Mary A. Tuck in Support of Mag Instrument, Inc.'s Opposition to Nordic Technologies Inc.'s Motion for Leave to File an Amended Answer and Counterclaim.

*Mag Instrument, Inc.* v. *Nordic Technologies, Inc.,* U.S. District Court, Central District of California, Case No. 00–11265 MMM (MANx)—Defendant's Reply to Mag Instrument, Inc.'s Opposition to Nordic's Motion for Leave to File an Amended Answer and Counterclaim to the Complaint of Plaintiff Mag Instrument, Inc.

*Mag Instrument, Inc.* v. *Nordic Technologies, Inc.,* U.S. District Court, Central District of California, Case No. 00–11265 MMM (MANx)—Declaration of L. David Griffin in Reply to Mag's Opposition to Nordic Technology, Inc.'s Motion for Leave to Amend.

Civil Minute Order entered Jun. 26, 2001 in *Mag Instrument, Inc.* v. *Nordic Technologies, Inc.,* U.S. District Court, Central District of California, Case No. 00–11265 MMM (MANx).

Order Denying Plaintiff's Motion to Dismiss Defendant's Counterclaim for Inequitable Conduct and Granting Defendant's Motion for Leave to Amend entered Jul. 2, 2001, *Mag Instrument, Inc.* v. *Nordic Technologies, Inc.,* U.S. District Court, Central District of California, Case No. 00–11265 MMM (MANx).

*Mag Instrument, Inc.* v. *Nordic Technologies, Inc.,* U.S. District Court, Central District of California, Case No. 00–11265 MMM (MANx)—Notice of Motion and Motion for Summary Judgment That Nordic AA Flashlight Literally Infringes Claims 2 and 3 of the '960 Patent, Claim 14 of the '336 Patent, and Claim 3 of '265 Patent.

*Mag Instrument, Inc.* v. *Nordic Technologies, Inc.,* U.S. District Court, Central District of California, Case No. 00–11265 MMM (MANx)—Memorandum of Points and Authorities in Support of Plaintiff's Motion for Summary Judgment of Literal Infringement of Claims 2 and 3 of the '960 Patent, Claim 14 of the '336 Patent, and Claim 3 of the '265 Patent.

*Mag Instrument, Inc.* v. *Nordic Technologies, Inc.,* U.S. District Court, Central District of California, Case No. 00–11265 MMM (MANx)—Statement of Uncontroverted Facts and Conclusions of Law Re Motion for Summary Judgment That Nordic AA Flashlight Literally Infringes Claims 2 and 3 of the '960 Patent, Claim 14 of the '336 Patent, and Claim 3 of the '265 Patent.

*Mag Instrument, Inc.* v. *Nordic Technologies, Inc.,* U.S. District Court, Central District of California, Case No. 00–11265 MMM (MANx)—Declaration of Mary A. Tuck in Support of Mag's Motion for Summary Judgment That Nordic AA Flashlight Literally Infringes Claims 2 and 3 of the '960 Patent, Claim 14 of the '336 Patent, and Claim 3 of the '265 Patent.

*Mag Instrument, Inc.* v. *Nordic Technologies, Inc.,* U.S. District Court, Central District of California, Case No. 00–11265 MMM (MANx)—Declaration of Martin J. Siegel in Support of Motion for Summary Judgment That Nordic AA Flashlight Literally Infringes Claims 2 and 3 of the '960 Patent, Claim 14 of the '336 Patent, and Claim 3 of the '265 Patent.

*Mag Instrument, Inc.* v. *Nordic Technologies, Inc.,* U.S. District Court, Central District of California, Case No. 00–11265 MMM (MANx)—Declaration of Jerrold B. Reilly in Support of Mag's Motion for Summary Judgment That Nordic AA Flashlight Literally Infringes Claims 2 and 3 of the '960 Patent, Claim 14 of the '336 Patent, and Claim 3 of the '265 Patent.

*Mag Instrument, Inc.* v. *Nordic Technologies, Inc.,* U.S. District Court, Central District of California, Case No. 00–11265 MMM (MANx)—Nordic's Opposition to Plaintiff's Motion for Summary Judgment of Literal Infringement of Claims 2 and 3 of the '960 Patent, Claim 14 of the '336 Patent and Claim 3 of the '265 Patent.

*Mag Instrument, Inc.* v. *Nordic Technologies, Inc.,* U.S. District Court, Central District of California, Case No. 00–11265 MMM (MANx)—Defendant Nordic's "Statement of Genuine Issues" in Response to Plaintiff's "Statement of Uncontroverted Facts and Conclusions of Law re: Motion for Summary Judgment That Nordic AA Flashlight Literally Infringes Claims 2 and 3 of the '960 Patent, Claim 14 of the '336 Patent, and Claim 3 of the '265 Patent".

*Mag Instrument, Inc.* v. *Nordic Technologies, Inc.,* U.S. District Court, Central District of California, Case No. 00–11265 MMM (MANx)—Declaration of Robert A. Aycock in Support of Nordic's Opposition to Plaintiff's Motion for Summary Judgment of Literal Infringement of Claims 2 and 3 of the '960 Patent, Claim 14 of the '336 Patent and Claim 3 of the '265 Patent.

*Mag Instrument, Inc.* v. *Nordic Technologies, Inc.,* U.S. District Court, Central District of California, Case No. 00–11265 MMM (MANx)—Reply in Support of Mag Instrument's Motion for Summary Judgment That Nordic AA Flashlight Literally Infringes Claims 2 and 3 of the '960 Patent, Claim 14 of the '336 Patent, and Claim 3 of the '265 Patent.

*Mag Instrument, Inc.* v. *Nordic Technologies, Inc.,* U.S. District Court, Central District of California, Case No. 00–11265 MMM (MANx)—Reply Declaration of Prof. Martin J. Siegel in Support of Plaintiff's Motion for Summary Judgment of Literal Infringement of Claims 2 and 3 of the '960, Claim 14 of the '336 and Claim 3 of the '265 Patent.

*Mag Instrument, Inc.* v. *Nordic Technologies, Inc.,* U.S. District Court, Central District of California, Case No. 00–11265 MMM (MANx)—Reply Declaration of Michele Fiorentine in Support of Plaintiff's Motion for Summary Judgment of Literal Infringement of Claims 2 and 3 of the '960, Claim 14 of the '336 and Claim 3 of the '265 Patent.

*Mag Instrument, Inc.* v. *Nordic Technologies, Inc.,* U.S. District Court, Central District of California, Case No. 00–11265 MMM (MANx)—Reply Declaration of Jerrold B. Reilly in Support of Mag Instrument's Motion for Summary Judgement That Nordic AA Flashlight Literally Infringes Claims 2 and 3 of the '960 Patent, Claim 14 of the '336 Patent and Claim 3 of the '265 Patent.

*Mag Instrument, Inc.* v. *Nordic Technologies, Inc.,* U.S. District Court, Central District of California, Case No. 00–11265 MMM (MANx)—Reply Declaration of John H. Wyatt in Support of Mag Instrument's Motion for Summary Judgment That Nordic AA Flashlight Literally Infringes Claims 2 and 3 of the '960 Patent, Claim 14 of the '336 Patent and Claim 3 of the '265 Patent.

*Mag Instrument, Inc.* v. *Nordic Technologies, Inc.,* U.S. District Court, Central District of California, Case No. 00–11265 MMM (MANx)—Memorandum in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Substitute Memorandum in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Declaration of Charles E. Van Horn in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Amended Declaration of Charles E. Van Horn in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Declaration of John D. McConaghy in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Declaration of Charles A. Kertell in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Declaration of Jon E. Hokanson.

*Mag Instrument, Inc.* v. *Nordic Technologies, Inc.,* U.S. District Court, Central District of California, Case No. 00–11265 MMM (MANx)—Declaration of David A. Randall in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Declaration of Robert W. Dickerson in Support of Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Nordic's Opposition to Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Defendant Nordic's "Statement of Genuine Issues" in Response to Plaintiff's "Statement of Uncontroverted Facts and Conclusions of Law re: Mag Instrument's Motion for Summary Judgment Dismissing Nordic's Claims of Inequitable Conduct".

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Opposition to Mag Instrument's Motion for Summary Judgment Dismissing Nordic's Claims in Inequitable Conduct.

*Mag Instrument, Inc.* v. *Nordic Technologies, Inc.,* U.S. District Court, Central District of California, Case No. 00–11265 MMM (MANx)—Mag Instrument Inc.'s Reply to Nordic Technologies, Inc.'s Opposition to Mag Instrument's Motion for Summary Judgment Dismissing Nordic's Claims of Inequitable Conduct.

*Mag Instrument, Inc.* v. *Nordic Technologies, Inc.,* U.S. District Court, Central District of California, Case No. 00–11265 MMM (MANx)—Nordic's Memorandum of Points and Authorities Supporting Its Motion for Judgment Summary Judgment of Non–Infringement of the '336 and '265 Patents.

*Mag Instrument, Inc.* v. *Nordic Technologies, Inc.,* U.S. District Court, Central District of California, Case No. 00–11265 MMM (MANx)—Opposition to Nordic's Motion for Summary Judgment of Non–Infringement of the '336 and '256 Patents.

*Mag Instrument, Inc.* v. *Nordic Technologies, Inc.,* U.S. District Court, Central District of California, Case No. 00–11265 MMM (MANx)—Mag Instrument's Statement of Genuine Issues of Material Fact in Opposition to Nordic's Motion for Summary Judgment Re Noninfringement of the '336 and '265 Patents.

*Mag Instrument, Inc.* v. *Nordic Technologies, Inc.,* U.S. District Court, Central District of California, Case No. 00–11265 MMM (MANx)—Declaration of Prof. Martin J. Siegel in Opposition to Nordic's Motion for Summary Judgment Re Non–Infringement of the '336 and '265 Patents.

*Mag Instrument, Inc.* v. *Nordic Technologies, Inc.,* U.S. District Court, Central District of California, Case No. 00–11265 MMM (MANx)—Declaration of Charles A. Kertell in Support of Plaintiff Mag Instrument, Inc.'s Opposition to Defendant Nordic Technologies, Inc.'s Motion for Summary Judgment Re Non–Infringement of the '336 and '265 Patents.

*Mag Instrument, Inc.* v. *Nordic Technologies, Inc.,* U.S. District Court, Central District of California, Case No. 00–11265 MMM (MANx)—Declaration of Jerrold B. Reilly in Opposition to Nordic's Motion for Summary Judgment Re Non–Infringement of the '336 and '265 Patents.

*Mag Instrument, Inc.* v. *Nordic Technologies, Inc.,* U.S. District Court, Central District of California, Case No. 00–11265 MMM (MANx)—Nordic's Reply to Mag's Opposition to Nordic's Motion for Summary Judgment Re Non–Infringement of the '336 and '265 Patents.

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Reply to Mag's Opposition to Nordic's Motion for Summary Judgment Re Non–Infringement of the '336 and '265 Patents.

*Mag Instrument, Inc.* v. *Nordic Technologies, Inc.,* U.S. District Court, Central District of California, Case No. 00–11265 MMM (MANx)—Nordic's Memorandum of Points and Authorities in Support of Its Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Nordic's Statement of Uncontroverted Facts and Conclusions of Law in Support of Its Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Motion for Summary Judgment of Invalidity Under 35 U.S.C. § 102(b) of the Asserted Independent Claims of the '960 Patent Based on Anticipation By The Mag '311 and Nelson '238 Patents.

*Mag Instrument, Inc.* v. *Nordic Technologies, Inc.,* U.S. District Court, Central District of California, Case No. 00–11265 MMM (MANx)—Opposition to Nordic's Motion for Summary Judgment of Invalidity Under 35 U.S.C. § 102(b) of the Asserted Independent Claims of the '960 Patent Based on Anticipation By The Mag '311 and Nelson '238 Patents.

*Mag Instrument, Inc.* v. *Nordic Technologies, Inc.,* U.S. District Court, Central District of California, Case No. 00–11265 MMM (MANx)—Mag Instrument's Statement of Genuine Issues of Material Fact in Opposition to Nordic's Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Mag's Objections to Testimony of Glen S. Calder In Support of Nordic's Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Declaration of Jerrold B. Reilly in Opposition to Nordic's Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Declaration of Professor Martin J. Siegel in Opposition to Nordic's Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Nordic's Reply to Mag's Opposition to Nordic's Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Reply to Mag's Opposition to Nordic's Motion for Summary Judgment of Invalidity Under 35 U.S.C. § 102(b) of the Asserted Independent Claims of the '960 Patent Based on Anticipation By the Mag '311 and Nelson '238 Patents.

*Mag Instrument, Inc.* v. *Nordic Technologies, Inc.,* U.S. District Court, Central District of California, Case No. 00–11265 MMM (MANx)—Defendant Nordic's Notice of Motion and Motion for Summary Judgment of Invalidity of the Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Nordic's Memorandum of Points and Authorities in Support of Its Motion for Summary Judgment of Invalidity of the Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Motion for Summary Judgment of Invalidity of the Asserted Claims Based on Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Mag Instrument's Opposition to Nordic's Motion for Summary Judgment of Invalidity of the Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Mag Instrument's Statement of Genuine Issues in Opposition to Nordic's Motion for Summary Judgment of Invalidity of The Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Declaration of Prof. Martin J. Siegel in Opposition to Nordic's Motion for Summary Judgment of Invalidity of the Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Declaration of Mary A. Tuck in Opposition to Nordic's Motion for Summary Judgment of Invalidity of the Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Nordic's Reply to Mag's Opposition to Nordic's Motion for Summary Judgment of Invalidity of the Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Reply to Mag's Opposition to Nordic's Motion for Summary Judgment of Invalidity of the Asserted Claims Based On Anticipation By Intervening Prior Art Under 35 U.S.C. § 102(b).

*Mag Instrument, Inc.* v. *Nordic Technologies, Inc.,* U.S. District Court, Central District of California, Case No. 00–11265 MMM (MANx)—Defendant Nordic's Notice of Motion and Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Nordic's Memorandum of Points and Authorities in Support of Its Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Defendant's Statement of Uncontroverted Facts and Conclusions of Law in Support of Its Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Memorandum in Opposition by Mag Instrument, Inc. to Nordic's Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Mag Instrument, Inc.'s Statement of Genuine Issues in Opposition to Defendant Nordic Technologies, Inc.'s Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Declaration of Katherine E. Hertel in Support of Plaintiff Mag Instrument, Inc.'s Opposition to Defendant Nordic Technologies, Inc.'s Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Declaration of Robert W. Dickerson in Support of Plaintiff Mag Instrument, Inc.'s Opposition to Defendant Nordic Technologies, Inc.'s Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Nordic's Reply to Mag's Opposition to Nordic's Motion for Summary Judgment of Unenforceability of the '265 and '960 Patents.

*Mag Instrument, Inc.* v. *Nordic Technologies, Inc.,* U.S. District Court, Central District of California, Case No. 00–11265 MMM (MANx)—Declaration of Robert E. Aycock in Support of Nordic's Reply to Mag's Opposition Motion for Summary Judgment of Unenforceability of the '265 and '960 Patents.

*Mag Instrument, Inc.* v. *Nordic Technologies, Inc.,* U.S. District Court, Central District, Case No. 00–11265 MMM (MANx)—Consent Judgment entered Feb. 7, 2003.

Court Docket Sheet as of Feb. 7, 2003, for *Mag Instrument, Inc.* v. *Nordic Technologies, Inc.,* U.S. District Court, Central District of California, Case No. 00–11265 MMM (MANx).

*Mag Instrument, Inc.* v. *Great Neck Saw Manufacturers, Inc., et al.,* U.S. District Court, Central District of California, Case No. CV 00–9925 CM (AJWx)—Consent Judgement and Permanent Injunction entered Jul. 6, 2001.

*Mag Instrument, Inc.* v. *Bison Sportslights, L.L.C., et al.,* U.S. District Court, Central District of California, Case No. EDCV–02–00280 VAP (SGLx)—[Stipulated] Final Judgment By Consent entered Dec. 30, 2002.

*Mag Instrument, Inc.* v. *Yun Sheng, Inc.,* U.S. District Court, Central District of California, Case No. EDCV 02–415 RT (SGLx)—Consent Judgment and Injunction entered Nov. 8, 2002.

*Mag Instrument, Inc.* v. *Mack's Sport Shop, etc.,* U.S. District Court, Central District of California, Case No. EDCV 03–102RT (SGLx)—Consent Judgment and Injunction entered Aug. 14, 2003.

*Mag Instrument, Inc.* v. *Signature Agency, Inc., et al.,* U.S. District Court, Central District of California, Case No. 01–05196 MMM (RCx)—Consent Judgment and Permanent Injunction, entered Apr. 9, 2002.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–11, 13 and 14 is confirmed.

Claims 12 and 15 are determined to be patentable as amended.

Claim 16, dependent on an amended claim, is determined to be patentable.

12. A flashlight powered by at least one battery, comprising:

a barrel assembly for retaining a battery source of power, said barrel assembly having a first end including threads;

a lamp bulb adjacent to said battery source of power;

a head assembly, said head assembly being removably coupled to the first end of said barrel assembly along the threads wherein rotation of said head assembly effects movement of said head assembly along the threads and axially along said barrel assembly;

a switch responsive to axial movement of said head assembly to close an electrical path between said lamp bulb and said battery source of power *that does not include conduction through said head assembly* and responsive to axial movement of said head assembly in the opposite direction to open said electrical path between said lamp bulb and said battery source of power, said switch including a first and second electrical contact in said path, the first of said contacts being stationary, and the second of said contacts being axially movable into and out of electrical contact with said first electrical contact to close and open said switch in response to rotation of said head assembly.

15. A flashlight powered by at least one battery, comprising:

a barrel assembly for retaining a battery source of power, the barrel assembly having a first end including threads;

a light source positioned at the first end of the barrel assembly;

a head assembly, the head assembly being adapted to receive the light source and being removably coupled to the first end of the barrel assembly and rotatable relative to the barrel assembly along the threads wherein rotation of the head assembly effects movement of the head assembly along the threads and axially along the barrel assembly;

a switch responsive to axial movement of the head assembly to close an electrical path between the light source and the battery source of power *that does not include conduction through the head assembly* and responsive to axial movement of the head assembly in the opposite direction to open the electrical path between the light source and the battery source of power, the switch including a first and second electrical contact in said path, the first of the contacts being stationary, and the second of the contacts being axially movable into and out of electrical contact with the first electrical contact to close and open the switch in response to rotation of the head assembly.

* * * * *